US005791060A

United States Patent [19]

Godsey

[11] Patent Number: 5,791,060

[45] Date of Patent: Aug. 11, 1998

[54] SIGHTING DEVICE FOR AN ARCHERY BOW

[76] Inventor: Samuel W. Godsey, 1001 Evergreen Ct., Plymouth, Wis. 53073

[21] Appl. No.: 556,598

[22] Filed: Nov. 13, 1995

[51] Int. Cl.[6] ..... F41G 1/467; F41G 1/32

[52] U.S. Cl. ..... 33/265; 33/241; 124/87

[58] Field of Search ..... 33/241, 265, 242, 33/243, 261; 124/87

[56] References Cited

U.S. PATENT DOCUMENTS

| | | | |
|---|---|---|---|
| Re. 24,313 | 5/1957 | Munsey | 33/241 |
| 2,642,661 | 6/1953 | Fredrickson | 33/265 |
| 2,875,522 | 3/1959 | Merril et al. | 22/265 |
| 3,098,303 | 7/1963 | Plisk | 33/241 |
| 3,121,163 | 2/1964 | Rickert . | |
| 3,320,671 | 5/1967 | Rickert et al. . | |
| 3,526,037 | 9/1970 | Crosby | 33/265 |
| 3,945,127 | 3/1976 | Spencer . | |
| 4,030,203 | 6/1977 | Ackerman, Jr. . | |
| 4,070,763 | 1/1978 | Carts, Jr. . | |
| 4,177,572 | 12/1979 | Hindes | 33/241 |
| 4,220,983 | 9/1980 | Schroeder | 33/241 |
| 4,521,972 | 6/1985 | Larson | 33/265 |
| 4,535,544 | 8/1985 | Jones et al. | 33/241 |
| 4,638,565 | 1/1987 | Podany et al. | 33/241 |
| 4,928,394 | 5/1990 | Sherman . | |
| 4,977,677 | 12/1990 | Troescher et al. | 33/241 |
| 5,086,567 | 2/1992 | Tutsch . | |
| 5,090,805 | 2/1992 | Stawarz . | |
| 5,092,052 | 3/1992 | Godsey | 33/265 |
| 5,094,002 | 3/1992 | Saunders | 33/241 |
| 5,168,631 | 12/1992 | Sherman . | |
| 5,231,765 | 8/1993 | Sherman | 33/241 |
| 5,442,861 | 8/1995 | Lorocco | 33/241 |

OTHER PUBLICATIONS

"Buck Rub Archery, Inc. Wholesale Catalog 1994–1995", published by Buck Rub Archery, Inc., Waukesha, Wisconsin, pp. 29–32, 1994 No Month.

Truglo Powrdot advertisement by Specialty Archery Products, *American Bow Hunter*, Oct., 1995, p. 11.

*Primary Examiner*—Thomas B. Will

*Attorney, Agent, or Firm*—Michael Best & Friedrich LLP

[57] ABSTRACT

A sighting device for use on an archery bow has one or more light gathering fibers that are substantially parallel to the archer's line of sight, instead of being bent as in prior sighting devices. The sighting device is preferably injection molded, and has two cross hairs that are also injection molded at the same time as the body member. The light gathering fiber is disposed in the body member at the point of intersection of the cross hairs, and may be press-fit into place. A threaded bolt, which attaches the sighting device to the archery bow, has an end that is overmolded with the body member to form an integral unit. Additional light gathering fibers may be used for different distances, with each of the fibers being substantially parallel to the archer's line of sight. The sighting device may optionally include a source of artificial light for low light conditions, or a lens that is normal to the fiber and that retains the fiber parallel with the archer's line of sight.

23 Claims, 1 Drawing Sheet

SIGHTING DEVICE FOR AN ARCHERY BOW

BACKGROUND OF THE INVENTION

This invention relates to sighting devices for archery bows. More particularly, this invention relates to bow sighting devices that use light gathering fibers.

In recent years, light gathering fibers have been used in sighting devices for archery bows. These light gathering fibers are able to gather light along their entire lengths, and pass some of the light through an end of the fiber to provide an illumination point. The archer uses the illumination point to aim an arrow at a target.

In a typical prior art sighting device having a light gathering fiber, the length of fiber is retained in a holder, and a bend is made near the end or the illumination point of the fiber. U.S. Pat. No. 5,442,861 issued Aug. 22, 1995 to Lorocco and U.S. Pat. No. 4,928,394 issued May 29, 1990 to Sherman both disclose this type of sighting device. In such prior art sighting devices, the light gathering fiber typically extends from a side of the holder, and is bent toward the viewing end of the sighting device. Thus, a portion of light gathering fiber other than the illumination point is seen by the archer during use of the sighting device. Unfortunately, the archer may be distracted and confused when he views that portion of the fiber which is not along his line of sight to the target because that portion of the fiber also emits a certain amount light. The fact that the archer may view a portion of the fiber that is not parallel to his line of sight makes it more difficult for him to precisely align the arrow with the intended target.

Another disadvantage of such prior art sighting devices is that the bend in the light gathering fiber also results in transmission losses of light which may have been gathered along the length of the fiber. Therefore, the use of a bend in the fiber may result in a somewhat less bright illumination point at the end of the fiber.

SUMMARY OF THE INVENTION

A sighting device for use by an archer on an archer bow is disclosed which overcomes the disadvantages of the prior art.

The sighting device of the present invention includes a length of a light gathering fiber, wherein substantially the entire length of the fiber is substantially parallel to the archer's line of sight, and a means for retaining the fiber substantially parallel to the archer's line of sight. In one embodiment, the retaining means includes a tubular body member or a holder that is disposed around at least a portion of the fiber. At least one sight hair segment, and preferably up to four sight hair segments, extend between the holder or body member and the fiber, and support and retain the fiber substantially parallel to the archer's line of sight. In a preferred embodiment, four sight hair segments comprise two cross hairs that intersect at 90 degree angles, with the fiber being disposed near the point of intersection of the cross hairs. In an alternate embodiment, the retaining means may include a lens having a longitudinal axis that is substantially normal to the fiber.

The present invention may include other features, such as a lighting device for illuminating the light gathering fiber, or one or more additional lengths of light gathering fibers, at least a portion of which are substantially parallel to the first light gathering fiber. The additional light gathering fibers may be used by the archer for sighting at one or more additional distances.

By placing the light gathering fiber substantially parallel to the line of sight, the archer is not confused or distracted as in prior art sighting devices since the only portion of the light gathering fiber that is visible to the archer is its very end, which provides a clear illumination point and aiming sight.

Another advantage of the present invention is that the light transmission losses resulting from bends in the prior art light gathering fibers are expected to be reduced, so that the illumination point is expected to be somewhat brighter than the prior art sighting devices.

Another feature of the present invention is that it is inexpensive to manufacture when compared to prior art devices. In a preferred embodiment, the retaining means or holder is injection molded integral with the hair segment members, and a portion of the retaining means is molded over an end of a threaded shaft that is used to attach the sighting device to the archery bow. In this way, the more expensive, metal insert ring of prior art devices is eliminated.

Several features and advantages of the present invention have been discussed above. Additional features and advantages will be apparent from the following detail description of the invention and the drawings, in which:

DETAIL DESCRIPTION OF THE INVENTION

Figure 1:
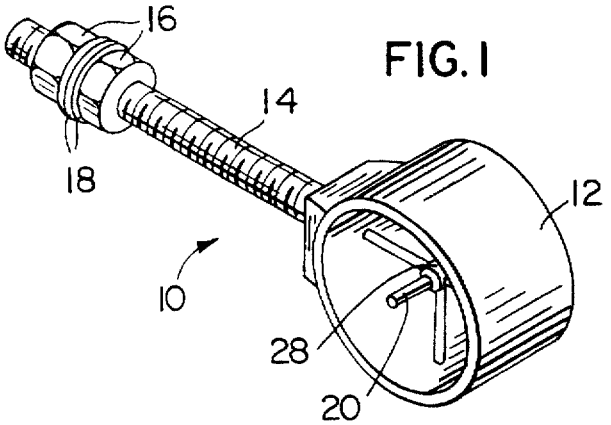
FIG. 1 is a perspective view of a sighting device according to the present invention.
Figure 2:
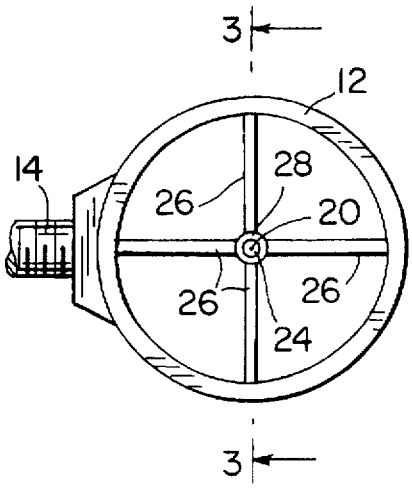
FIG. 2 is an end view of the sighting device of FIG. 1.
Figure 3:
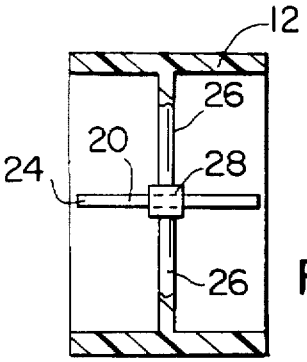
FIG. 3 is a cross-sectional side view of the sighting device, taking along line 3—3 of FIG. 2.

FIGS. 1 through 3 relate to a first embodiment of the present invention. In FIGS. 1 through 3, sighting device 10 includes a tubular holder or body member 12 which is overmolded to an elongated threaded attachment member 14. Attachment member 14 is attached to an archery bow by means of nuts 16 and washers 18.

Body member or holder 12 is preferably cylindrical or tubular in shape, and may be cut from a piece of tube stock. In the alternative, body member 12 is injection molded, and is integrally formed with steel attachment member 14 by overmolding.

A length of a light gathering fiber 20 is disposed substantially within body member 12, as depicted in FIGS. 1 through 3. Fiber 20 does not need an artificial light source, although an artificial light source may be used, such as light source 22 depicted in FIGS. 4 and 5. Fiber 20 is readily available from several suppliers, including Polyoptical Products of California. Fiber 20 gathers light along its entire length, and is preferably a fluorescent color such as green or orange. It is preferred that fiber 20 is no longer than the length of body member 12, as best shown in FIG. 3. Fiber 20 is preferably two inches long or less.

As best shown in FIGS. 2 and 3, fiber 20 is substantially linear, and does not have a bend which is typical in prior art light gathering fibers. Fiber 20 is aligned substantially parallel to the archer's line of sight to the target, unlike in prior art devices, where a substantial portion of the fiber is not aligned with the archer's line of sight.

Figure 4:
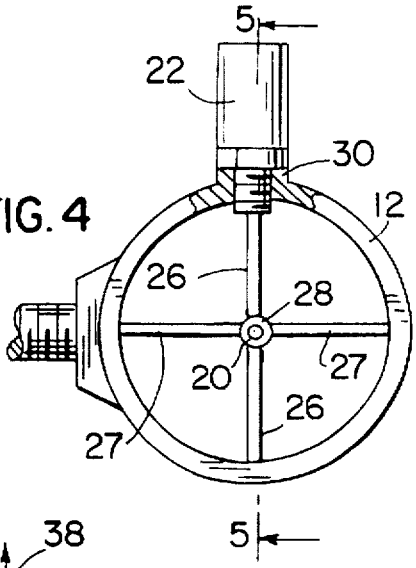
FIG. 4 is an end view of an alternate embodiment of the sighting device, having a lighting unit.
Figure 5:
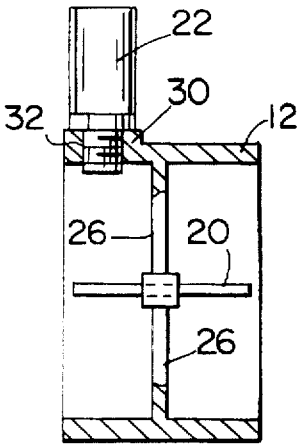
FIG. 5 is a cross-sectional side view of the alternate embodiment, taken along line 5—5 of FIG. 4.

FIG. 2 is an end view of the sighting device as it may appear to the archer when he is trying to aim the arrow at a target. As shown in FIG. 2, the only portion of fiber 20 that is visible to the archer when he is aiming the arrow is end 24 of the fiber. Light which strikes fiber 20 is transmitted to end 24, so that end 24 becomes an aiming or an illumination point to assist the archer in aiming the arrow. As best shown in FIGS. 2 and 4, the brightly colored illumination point 24, particularly when surrounded by the cross hair members, will greatly assist the archer in hitting the target.

Fiber 20 may be retained in parallel relationship with the archer's line of sight in several ways. One way is to provide one or more sighting hair segments 26 and 27 which extend between body member 12 and fiber 20. In a preferred embodiment, four sighting hair segments are used, with one pair of sighting segments 26 being collinear to each other and disposed at right angles to a second pair of sighting segments 27. In other words, the two vertically disposed sighting segments 26 make up a vertical cross hair member, whereas the two horizontal segments 27 make up a horizontal cross hair member. All of the sighting hair segments meet at a cylindrical member 28, in which fiber 20 is disposed and retained. Fiber 20 may be press-fit into cylindrical member 28, or fiber 20 may be glued or otherwise affixed to cylindrical member 28.

Sighting hair members 26 and 27 are preferably integrally formed with body member 12 during an injection molding process. Also, cylindrical member 28 is integrally formed with sighting hair members 26 and 27 and body member 12 during the injection molding process. Body member 12 may have a draft angle to make it easier to break body member 12 out of the mold. It is preferred that the draft angle be formed on the body member section which is furthest away from the archer's eye during use, to provide a margin of error for misalignment of the sighting device with the target.

If body member 12, sighting hair members 26 and 27, and cylindrical member 28 are made from a clear plastic material, clear polycarbonate may be used. In applications where the archer prefers a black sighting device, black polycarbonate may be used. In the alternative, body member 12, the hair members and the cylindrical member may be made from nylon or a metal.

As discussed above, FIGS. 4 and 5 depict an alternate embodiment of the present invention in which a lighting device 22 may be used to illuminate light gathering fiber 20. Since fiber 20 gathers light along its entire length, the lighting device may be aimed at any portion of fiber 20. Lighting device 22 may be desirable in low light conditions, such as at dawn or dusk. When a lighting device is to be used, body member 12 preferably has a boss 30 which is thicker than the remainder of body member 12. An aperture 32 is drilled and tapped in boss 30 for receiving a threaded attachment member of lighting device 22. A number of suitable lighting devices are currently available, such as the LIGHT ALL lighting device part number C-004 available from Cobra Manufacturing Company, Inc. of Bixby, Okla.

Figure 6:
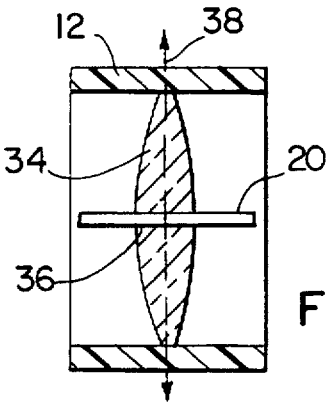
FIG. 6 is a cross-sectional side view of another embodiment, having a lens.

FIG. 6 depicts another alternate embodiment of the present invention in which fiber 20 is retained by a lens 34. Lens 34 provides a magnification in the range of two to about 10 power to assist the archer in aiming the arrow. The lens may be made of glass or a lens grade plastic material, as is well known in the art. It is preferred that lens 34 has an aperture 36 formed therein, through which fiber 20 passes. Fiber 20 is retained in position by lens 34. As shown in FIG. 6, lens 34 has a longitudinal axis 38 that is substantially normal to fiber 20.

Another optional feature of the present invention is to provide one or more additional lengths of light gathering fiber, with each of these additional fibers having at least a portion that is substantially parallel to fiber 20. The additional fibers preferably are of a different color than fiber 20, are positioned above or below fiber 20 within body member 12, and are also substantially parallel to the archer's line of sight. These additional fibers may be used to provide aiming points for different distances to the target.

While several embodiments of the present invention have been shown and described, alternate embodiments will be apparent to those skilled in the art and are within the intended scope of the present invention. Therefore, the invention is to be limited only by the following claims.

I claim:

1. A sighting device for use by an archer on an archery bow, said archer aiming an arrow at a target along a line of sight, said sighting device comprising:

a length of a rod-like light gathering fiber, substantially the entire length of said fiber being substantially parallel to said line of sight; and a holder that retains said fiber substantially parallel to said line of sight wherein said holder includes at least one sighting hair member extending between said holder and said fiber, said fiber being supported only by said at least one sighting hair member.

2. The sighting device of claim 1, wherein said holder is disposed around at least a portion of said fiber.

3. The sighting device of claim 1, wherein said at least one sighting hair member includes:

two hair members disposed at a right angle to each other, said fiber being disposed near the vertex of said right angle.

4. The sighting device of claim 1, wherein said at least one sighting hair member is integral with said holder.

5. The sighting device of claim 4, wherein said at least one sighting hair member and said holder are integrally formed of a plastic material by an injection molding process.

6. The sighting device of claim 1, further comprising:

an attachment member that attaches said holder to said archery bow.

7. The sighting device of claim 6, wherein said attachment member is integral with said holder, a portion of said holder being injection molded over a portion of said attachment member.

8. The sighting device of claim 1, further comprising:

a lighting device, interconnected with said holder, that provides light to said light gathering fiber.

9. The sighting device of claim 1, wherein said holder is transparent.

10. The sighting device of claim 1, wherein said at least one sighting hair member is transparent.

11. The sighting device of claim 1, further comprising:

an attachment member that attaches said holder to the archery bow, wherein said at least one sighting hair member and said attachment member are both integral with said holder.

12. The sighting device of claim 11, wherein said holder is integrally formed with said attachment member by overmolding.

13. The sighting device of claim 12, wherein said at least one sighting hair member and said holder are integrally formed of a plastic material by a molding process.

14. A sighting device for use by an archer on an archery bow, said archer aiming an arrow at a target along a line of sight, said sighting device comprising:

a length of a rod-like light gathering fiber, said fiber being substantially parallel to said line of sight along substantially the entire length of said fiber; and means for retaining said fiber substantially parallel to said line of sight, said retaining means including a body member and at least one sight hair member having a first end that extends from said body member and having a second end that is interconnected with said fiber, said fiber being supported only by said at least one sight hair member.

15. The sighting device of claim 14, wherein said retaining means includes:

a tubular member that is disposed around at least a portion of said fiber.

16. The sighting device of claim 14, further comprising:

means for attaching said sighting device to said archery bow.

17. The sighting device of claim 16, wherein said attachment means includes a threaded shaft.

18. The sighting device of claim 17, wherein an end of said threaded shaft is connected to said retaining means by molding a portion of said retaining means over said shaft end.

19. The sighting device of claim 14, wherein said at least one sight hair member and said retaining means are integrally formed by an injection molding process.

20. The sighting device of claim 14, wherein said at least one sight hair member includes four sight hair segments, each of said sight hair segments having an end that extends from said body member, and each of said four hair segments having an opposite end that is interconnected with said fiber.

21. The sighting device of claim 14, further comprising:

a lighting device, interconnected with said retaining means, that provides light to said light gathering fiber.

22. The sighting device of claim 14, wherein said body member is transparent.

23. The sighting device of claim 14, wherein said at least one sight hair member is transparent.

* * * * *